United States Patent [19]

Marsh et al.

[11] 4,050,939

[45] Sept. 27, 1977

[54] MICROIMAGING FILM CONTAINING AN ORGANO DISELENIDE, A TERTIARY PHOSPHINE OR PHOSPHITE AND AN ORGANIC PEROXIDE

[75] Inventors: Dana G. Marsh, Rochester; Joseph Y. C. Chu, Fairport, both of N.Y.

[73] Assignee: Xerox Corporation, Stamford, Conn.

[21] Appl. No.: 749,635

[22] Filed: Dec. 13, 1976

[51] Int. Cl.[2] ..... G03C 1/84

[52] U.S. Cl. ..... 96/88; 96/90 R

[58] Field of Search ..... 96/88, 90 R

[56] References Cited

U.S. PATENT DOCUMENTS

| | | | |
|---|---|---|---|
| 3,445,232 | 5/1969 | Shurey | 96/90 R |
| 3,544,322 | 12/1970 | Yamada et al. | 96/90 R |
| 3,967,964 | 7/1976 | Marsh et al. | 96/88 |

*Primary Examiner*—Won H. Louie, Jr.
*Attorney, Agent, or Firm*—James J. Ralabate; James P. O'Sullivan; Jerome L. Jeffers

[57] ABSTRACT

Disclosed is a microimaging composition which comprises a film of an organic polymer as a matrix material having uniformly dispersed therein:

i. a photochemically reactive organo diselenide characterized by the formula:

$R_1$—Se—Se—$R_2$ wherein $R_1$ and $R_2$ are aralkyl or alkyl hydrocarbon moieties;

ii. a tertiary phosphine or phosphite characterized by the formula:

wherein each $n$ is 0 in the case of a phosphine and 1 in the case of a phosphite and $R_3$, $R_4$ and $R_5$ are independently substituted or unsubstituted aryl hydrocarbon moieties; and iii. an organic peroxide characterized by the formula:

wherein $R_6$ and $R_7$ are aryl or substituted aryl.

10 Claims, 2 Drawing Figures

MICROIMAGING FILM CONTAINING AN ORGANO DISELENIDE, A TERTIARY PHOSPHINE OR PHOSPHITE AND AN ORGANIC PEROXIDE

BACKGROUND OF THE INVENTION

Microimaging schemes based upon photoreactions of chalcogen compounds, for example, benzyl diselenide, and photoreactions of chalcogen compounds with mercury compounds have been proposed which possess desirable features which render their use advantageous in many situations. However, these imaging systems based upon the photochemistry of chalcogen compounds have the disadvantage of instability in that they are not easily fixed.

It is known that the direct photochemistry of benzyl diselenide (BDS) with ultraviolet light results in the formation of dibenzylselenide (DBS) and selenium. This is shown in equation 1 along with the back reaction:

$$(R\ Se)_2 \overset{h\nu}{\rightleftharpoons} R_2Se + Se^{\circ} \qquad (1)$$

It is further known that triphenylphosphine (TPP) will react with elemental selenium and with selenium radicals to produce triphenylphosphineselenide, a colorless product. In solution, this leads to increases in the quantum yield for the disappearance of benzyl diselenide presumably via secondary free radical reactions. This reaction occurs as well in solid films and forms a latent image of triphenylphosphineselenide, which if developed would provide additional contrast above and beyond that obtained by direct photolysis in the absence of this scavenging reagent.

An object of the present invention is to provide an improved process for the manufacture of microimaging film structures.

A further object is to provide a microimaging film with gain.

An additional object is to provide a microimaging film with both high contrast and high resolution.

Another object is to provide a stable microimaging film, that is one that may be fixed to preserve the image contrast, and prevent unwanted and undesirable subsequent fogging and reimaging.

SUMMARY OF THE INVENTION

The present invention involves a novel imaging method having special applicability for use in microimaging processes. The method comprises:

a. providing a film of an organic polymer as matrix material having uniformly dispersed therein:

i. a photochemically reactive organo diselenide characterized by the formula:

$$T_1—Se—Se—R_2$$

wherein $R_1$ and $R_2$ are aralkyl or alkyl hydrocarbon moieties;

ii. a tertiary phosphine or phosphite characterized by the formula:

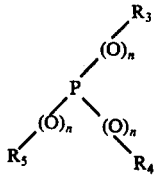

wherein each $n$ is 0 in the case of a phosphine and 1 in the case of a phosphite and $R_3$, $R_4$ and $R_5$ are independently substituted or unsubstituted aryl hydrocarbon moieties; and iii. an organic peroxide characterized by the formula:

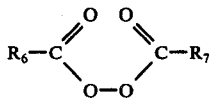

wherein $R_6$ and $R_7$ are aryl or substituted aryl;

b. exposing the film in an imagewise manner to ultraviolet radiation to form an image therein; and c. heating the exposed film to a temperature of at least about 100° C for a time sufficient to enhance the image contrast.

This invention also involves the microimaging film useful in the process.

DETAILED DESCRIPTION AND PREFERRED EMBODIMENTS

Figure 1:
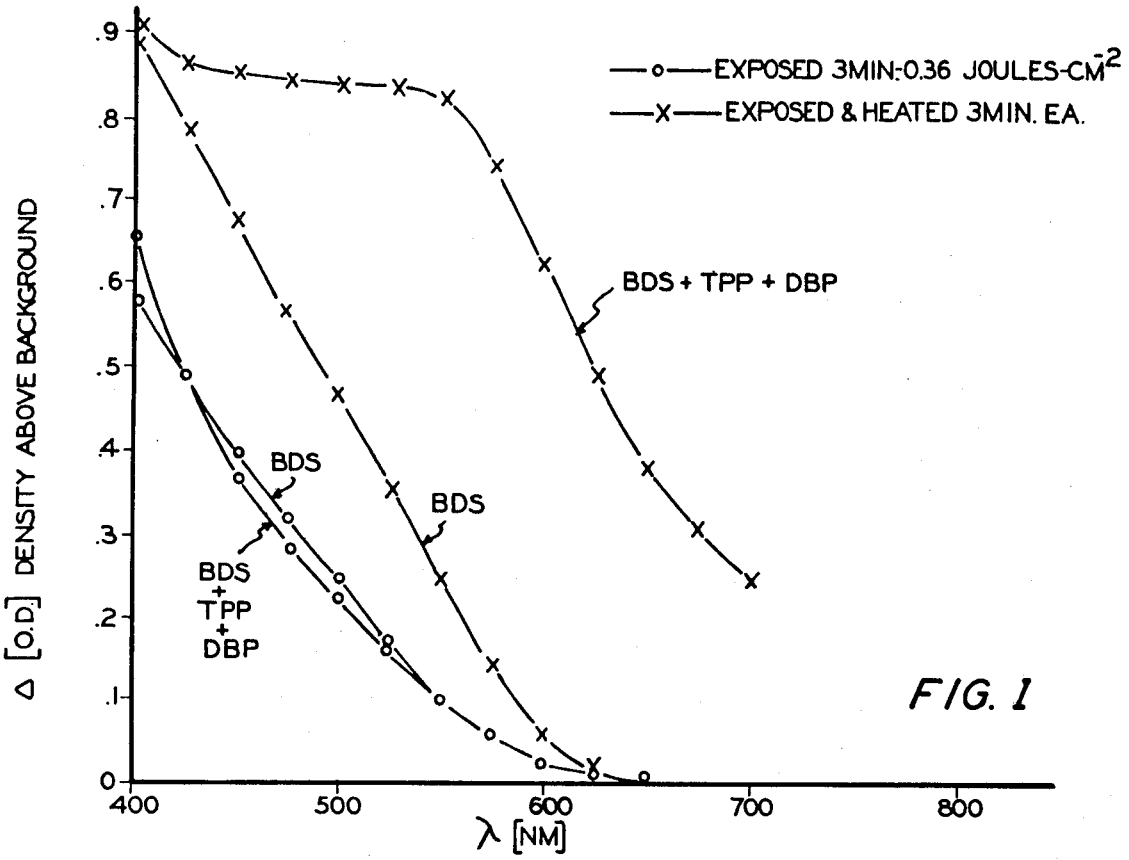

This invention is predicated on the discovery that incorporation of suitable loadings of a chalcogen compound, a scavenging compound and an oxidizing compound in a polymeric binder matrix results in microimaging films which exhibit, upon imagewise exposure to ultraviolet radiation, stable images exhibiting high contrast and resolution which may be developed (gain) by gentle heating. Further heating will, in some cases, fix the image to render the imaged film less susceptible to fogging and reimaging.

The photochemically reactive diselenides useful in the process of the present invention are selected from those organo diselenides corresponding to the formula:

$$R_1—Se—Se—R_2$$

These compounds are capable of undergoing a decomposition reaction in response to activating radiation and yielding, as one of the products of such decomposition, elemental selenium. Typical of suitable compounds corresponding to the above formula and which may be used are those organo diselenides wherein $R_1$ and $R_2$ are independently selected from the group of benzyl, alkyl substituted benzyl, amino substituted benzyl, amido substituted benzyl, arylalkyl substituted benzyl, aryl substituted benzyl, alkoxy alkyl substituted benzyl, amino alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxy substituted benzyl, cyano substituted benzyl and alkyl alkoxy, amino substituted alkyl, amido substituted alkyl, aryl alkyl, alkoxy alkyl, aryloxy alkyl, hydroxy substituted alkyl, carbonyl substituted alkyl, thio substituted alkyl, seleno substituted alkyl, carboxamido substituted alkyl, halogen substituted alkyl and nitro substituted alkyl; cyclo alkyl and substituted cyclo alkyl.

Many of the compounds within the scope of the above formula are readily available, and those not so available can be prepared by methods disclosed in the technical literature. For example, symmetrical dialkyl selenides can be prepared by the reaction of an alkyl halide with sodium selenide, M. L. Bird et al, J. Chem. Soc. 570 (1942); R. Paetzold et al, L. Amorg. Allg. Chem., 360, 293 (1968). The general method for the preparation of unsymmetrical dialkyl selenides is a modified Williamson synthesis, H. Rheinboldt, "Houben-Weyl Methodender Organischen Chemie", Volume IX, E. Muller, Ed., Georg Thieme Verlag, Stuttgart, pp. 972, 1005, 1020 and 1030 (1955).

Diselenides within the scope of the above formula can be prepared by alkaline hydrolysis of organo selenocyanates as disclosed by H. Bauer in Chem. Ber., 46, 92 (1913). The preparation of unsymmetrical diselenides suitable for use in the invention is accomplished by the reaction of organic selenyl bromides with organic selenols, H. Rheinboldt and E. Giesbrecht, Chem. Ber., 85, 357 (1952). Heterocyclic selenium compounds capable of undergoing substantial carbon-selenium bond scission upon irradiation with ultraviolet light can be prepared by the reaction of organic bromides with organic selenium compounds, L. Chierici et al, Ric. Sci., 25, 2316 (1955).

It should be noted that certain alkyl substituted selenium compounds will be liquids when low molecular weight alkyl substituents are employed. Since solid materials are generally preferred due to ease of film formation, those dialkyl diselenides in which the aggregate number of carbon atoms is at least about 20 will be preferred for film formation.

Those tertiary phosphines useful in the presently disclosed imaging process are characterized by the formula:

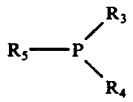

wherein $R_3$, $R_4$ and $R_5$ are independently selected from the group of substituted or unsubstituted aryl hydrocarbon moieties. Typical examples of tertiary phosphines suitable for use in the present invention are triphenylphosphine; tri-para-methoxyphenylphosphine; ortho-bromophenyldiphenylphosphine; tri-orthotolylphosphine; tri-metatolylphosphine; tris-para-fluorophenylphosphine; and para-tolyldiphenylphosphine.

Also useful in the present invention are tertiary phosphites characterized by the formula:

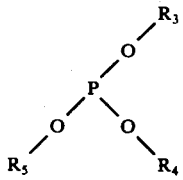

wherein $R_3$, $R_4$ and $R_5$ are as defined above. Exemplary of tertiary phosphites which may be used are triphenylphosphite; and tri-para-tolylphosphite.

The organic peroxide is characterized by the formula:

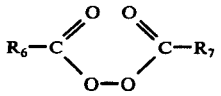

wherein $R_6$ and $R_7$ are aryl or substituted aryl. Preferred organic peroxides include dibenzoylperoxide and para substituted dibenzoylperoxide. Preferred para substituents are alkyl groups of 1 to 4 carbon atoms.

The polymeric matrix material is comprised of an organic film forming polymer capable of forming a film which is transparent or translucent to the activating radiation used to image the film, i.e. ultraviolet light. The polymer can consist solely of carbon and hydrogen although substituted polymers such as poly(vinylchloride) can be used. Preferred polymers are those which have glass transition temperatures (Tg) greater than about 100° C. This is deemed to be the case because the imaging films are heated to fix the image and those polymers having glass transition temperatures below the heating temperature will tend to soften allowing the image to diffuse, which diffusion results in a decrease in resolution. Exemplary of polymers useful as the matrix polymer are poly(vinylformal), poly(vinylbutyral), poly(vinylalcohol), poly(methylmethacrylate), poly(vinylpyrrolidone) and poly(vinylidenechloride). Copolymers and block copolymers may also be employed as the matrix material.

Upon selection of the appropriate matrix polymer, organo diselenide, tertiary phosphine or phosphite and organic peroxide, the imaging film is prepared by dissolving these constituents in a suitable solvent and applying the so-formed solution to a suitable substrate in a thin layer. Evaporation of the solvent leaves a film which, when exposed to activating radiation and heat, bears a visible image corresponding to the exposed areas. Suitable solvents are those compositions which dissolve the materials and do not detrimentally interact with them. Such solvents include tetrahydrofuran, carbon disulfide, acetone, methyl ethyl ketone and methylene dichloride.

The relative proportions of the matrix polymer, organo diselenide, tertiary phosphine or phosphite and organic peroxide are not critical, provided the matrix polymer is the principal ingredient. Typically, the organo diselenide will account for from about 25 to 40 weight percent of the imaging film. The tertiary phosphine or phosphite is preferably employed in an amount of 15 to 25 weight percent of the film with the organic peroxide perferably accounting for from 20 to 30 weight percent of the imaging film.

Exemplary of substrates upon which the imaging film may be cast are Mylar, glass, metals and coated papers. If desired, the dried film can be stripped from the substrate either before or after imaging. The thickness of the film is not critical but is generally at least about 1 micron because of fabrication problems with submicron films. Film thicknesses up to about 5 microns or more are satisfactory. The process of forming the film may include roller coating, knife coating, mil coating, brushing, etc. A preferred method is to use a doctor blade as applicator.

Upon casting the film and evaporating the solvent, optionally with gentle heating and/or evacuation under high vacuum to accelerate solvent removal, the composition is ready for imaging which is accomplished by subjecting it to ultraviolet radiation in an imagewise fashion, i.e. irradiating the film in those areas in which the image is desired. This is normally accomplished by placing a stencil or negative having areas which are opaque and transparent to the radiation between the light source and the film and directing the ultraviolet light through this barrier to the film.

After imaging, the films are heated to a temperature of at least about 100° C to enhance the image by increasing the optical density difference between the imaged and background areas. The films are fixed to visible light and can therefore be projected with visible light projectors without affecting the image. In addition, the imaged films can be safely handled in room light for lengthy periods with no apparent deterioration. In some cases, the films can be fixed to prevent further imaging by ultraviolet radiation by additional heating to a temperature of at least about 100° C.

The present invention is further illustrated by the following examples in which all percentages are by weight unless otherwise specified.

EXAMPLE I

Films of polymethylmethacrylate (PMMA), containing benzyl diselenide (BDS), triphenylphosphine (TPP), and dibenzoylperoxide (DBP) are prepared by solvent casting from dichloromethane or tetrahydrofuran the following composition: 10% PMMA, 5% BDS, 5% TPP and 5% DBP onto a Mylar film using a Gardner mechanical drive film coating apparatus with a 4 mil gap applicator bar. The coated film is dried overnight to remove the solvent.

A control film containing only 5% benzyl diselenide (no TPP or DBP) in PMMA is prepared in an identical fashion.

The microimaging film and the control film are exposed to the filtered output of a high pressure, point source, mercury arc for three minutes. This exposure ($Ia \times t$) using the 365 nm line of mercury corresponds to a total of 0.36 joule-cm$^{-2}$. Both the control film and the microimaging film develop a red-brown image in the light struck areas.

Figure 2:
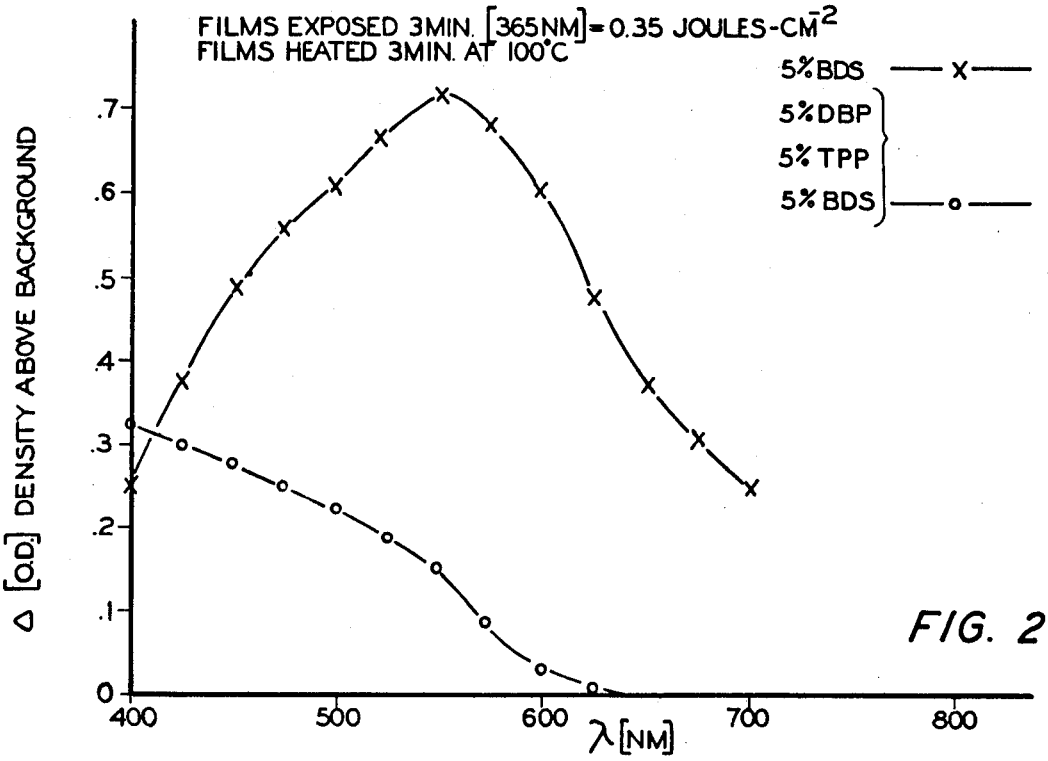

The difference in optical density between imaged and background areas (ΔO.D.) are shown in FIG. 1 as the curves through the open circles. The imaging films and control films are heated for three minutes on a flat hot plate at 100° C. The imaged areas are observed to increase in optical density, while at the same time, the unimaged background areas are fixed. The increases in ΔO.D. are shown as the curves through the crosses in FIG. 1. It can be observed that a considerable change in the optical density occurs upon heating. Changes in optical density for the microimaging film and the control film are shown in FIG. 2. One immediate observation is that the incorporation of the triphenylphosphine and dibenzoylperoxide have enabled the formation and development of the latent triphenylphosphine-selenide image and enhanced the contrast. An unexpected result is the panchromaticity of the image as compared with the control.

EXAMPLE II

An imaging film is prepared using the composition described in Example I. The film is exposed to actinic radiation as described in Example I for 60 sec. Heating the film to 100° C for 60 sec. provides an imaged film having an optical density of 0.40 above background from 500 to 600 nm.

EXAMPLE III

An imaging film of the composition described in Example I, except that p-methoxytriphenylphosphine is substituted for TPP, is imaged using the 436 nm mercury line as activating radiation and then heated to 100° C for 180 sec. to enhance the contrast. Under these conditions a ΔO.D. of 0.02 results after three minutes of exposure; after heating the optical density difference is observed to increase to 0.09.

A further experiment is carried out to demonstrate the heat-fixing potential. A previously imaged film sample is first heated for three minutes at 100° C and then imaged for three minutes using the 436 nm line. Under these conditions, the optical density change is only 0.01 which indicates that the image has been partially fixed.

EXAMPLE IV

The microimaging films described in Example III are exposed to activating radiation of 365 nm in wavelength for periods of three minutes followed by heat developments at 100° C for three minutes and the reverse order of heating following by imaging. Images are observed having optical densities above background of 0.60 and 0.375 respectively at 500 nm.

EXAMPLE V

Twelve microimaging films are prepared by casting from methylenedichloride solution the following composition: 10% poly(vinylformal), 5% BDS, 6% DBP, and 4% TPP. The films are cast on Mylar at room temperature using a Gardner mechanical draw blade apparatus set at an 8 mil gap. Each film is irradiated using an unfiltered mercury arc and the total amount of energy received by the film recorded. Six of the imaged films are heated to 100° C for varying time periods. The optical density above background is measured at 400 and 500 nm. The results of this experiment are set out in Table I.

TABLE I

| Sample | Irradiation Time (Minutes) | Total Light Energy (J/cm$^2$) | Heating Time at 100° C (Minutes) | Optical Density at 400 nm | Optical Density at 500 nm |
|---|---|---|---|---|---|
| 1 | 5 | 0.81 | 5 | 0.495 | 0.525 |
| 2 | 5 | 0.66 | 0 | 0.485 | 0.350 |
| 3 | 4 | 0.46 | 4 | 0.370 | 0.455 |
| 4 | 4 | 0.38 | 0 | 0.395 | 0.310 |
| 5 | 3 | 0.29 | 3 | 0.410 | 0.435 |
| 6 | 3 | 0.34 | 0 | 0.445 | 0.330 |
| 7 | 2 | 0.20 | 2 | 0.275 | 0.320 |
| 8 | 2 | 0.24 | 0 | 0.400 | 0.300 |
| 9 | 1 | 0.10 | 1 | 0.195 | 0.165 |
| 10 | 1 | 0.11 | 0 | 0.320 | 0.265 |
| 11 | 0.5 | 0.05 | 0.5 | ~0.100 | ~0.100 |
| 12 | 0.5 | 0.06 | 0 | 0.290 | 0.245 |

The following trends can be observed from the data of Table I: optical densities above background increase with increasing exposure or simultaneous increases in exposure and heating (development) times. The resolution of both heated and unheated films is found to be at least 228 lp/mm.

Films similar to those described above except that the loading of DBP is 7.5% are prepared. These films are imaged and developed with heating but are somewhat crystalline in nature and therefore not as desirable as those containing b 6% DBP.

EXAMPLE VI

Films are cast from a methylenechloride solution containing: 10% poly(vinylbutyral), 5% BDS, 6% DBP and 4% TPP. These films are exposed to unfiltered mercury arc radiation for various periods of time and the energy input recorded. Some of the films are heated to 100° C for varying lengths of time after imaging. Optical density above background is determined at 400 and 500 nm. The results of this experiment are set out in Table II.

TABLE II

| Sample | Irradiation Time (Minutes) | Total Light Energy (J/cm²) | Heating Time at 100° C (Minutes) | Optical Density at 400 nm | Optical Density at 500 nm |
|---|---|---|---|---|---|
| 1 | 5 | 0.33 | 0 | 0.620 | 0.280 |
| 2 | 5 | 0.60 | 5 | 0.460 | 0.210 |
| 3 | 4 | 0.90 | 0 | 0.450 | 0.625 |
| 4 | 4 | 0.96 | 4 | 0.375 | 0.180 |
| 5 | 3 | 0.83 | 0 | 0.270 | 0.165 |
| 6 | 3 | 0.79 | 3 | 0.430 | 0.590 |
| 7 | 2 | 0.35 | 0 | 0.220 | 0.135 |
| 8 | 2 | 0.60 | 2 | 0.395 | 0.435 |
| 9 | 1 | 0.20 | 0 | 0.115 | 0.095 |
| 10 | 1 | 0.20 | 1 | 0.295 | 0.230 |

The following trends can be observed from Table II: optical densities above background increase for increasing exposure and heating times up to three minutes. For exposure or heating times greater than 3 minutes, the results are more complex.

Resolution is found to degrade with heating in these films since minimum resolution is found to be 228 lp/mm before heating and 180 lp/mm after heating.

EXAMPLE VII

Microimaging films are cast from a methylenechloride solution containing: 10% poly(methylmethacrylate), 5% BDS, 7.5% DBP and 4% TPP. These films are exposed to unfiltered mercury arc radiation for varying lengths of time; some are heated to 93° C for varying lengths of time and the optical density above background of the exposed areas determined. The results of this experiment are set out in Table III.

TABLE III

| Sample | Irradiation Time (Minutes) | Total Light Energy (J/cm²) | Heating Time at 93° C (Minutes) | Optical Density at 400 nm | Optical Density at 500 nm |
|---|---|---|---|---|---|
| 1 | 5 | 1.40 | 5 | 0.89 | 0.71 |
| 2 | 5 | 1.00 | 0 | 0.41 | 0.29 |
| 3 | 2.5 | 0.82 | 2.5 | 0.81 | 0.75 |
| 4 | 4 | 0.89 | 0 | 0.54 | 0.38 |
| 5 | 2 | 0.67 | 2 | 0.73 | 0.55 |
| 6 | 3 | 0.63 | 0 | 0.90 | 0.75 |
| 7 | 2 | 0.38 | 1 | 0.46 | 0.35 |
| 8 | 2 | 0.38 | 0 | 0.35 | 0.25 |
| 9 | 1 | 0.18 | 0.25 | Latent images formed by exposure become just detectable upon heating. | |
| 10 | 0.25 | 0.09 | 0.23 | | |
| 11 | 0.25 | 0.05 | 0.5 | | |
| 12 | 0.5 | 0.09 | 0.5 | | |

Resolution degrades with heat development, minimum resolution for imaged films is 160 lp/mm, and after heating the resolution is 90 lp/mm.

EXAMPLE VIII

Microimaing films according to the instant invention are cast from methylenechloride solution containing: 10% Lexan polycarbonate, 5% BDS, 6.0% DBP, and 4% TPP. These films are exposed to unfiltered mercury arc radiation for varying lengths of time; some are heated to 88° C for varying lengths of time and the optical density above background for the exposed areas determined. It is observed that the optical densities of imaged and heated films show development after heating when the optical densities are measured against air. It is also observed that a film which is exposed to activating radiation for 4 minutes without prior heating provides optical densities above background of 0.56 and 0.18 at 400 nm and 500 nm respectively. Conversely, those films which are heated at 100° C for 2 minutes before heating provide optical densities above background of 0.009 and 0.005. This demonstrates that fixing occurs in Lexan films at about 100° C.

It is also discovered that resolution decreases in Lexan films upon heating. Thus, resolutions of 14 lp/mm are obtained in the unheated films whereas the resolution drops to 7 lp/mm after heating due to the crystallinity of films of this composition. In view of the above, it must be concluded that polycarbonates are not preferred for use as the matrix resin.

EXAMPLE IX

Microimaging films are cast from a methylenechloride solution containing the following ingredients: 10% cellulose acetate butyrate, 5% BDS, 6% BDP and 4% TPP. These films image upon exposure to activating radiation and the optical density of the images increases upon heating. The minimum exposure is found to be approximately 0.17 J/cm² with development for 30 seconds at 82° C necessary to provide a visible image.

EXAMPLE X

Microimaging films are cast from a methylenechloride solution containing the following ingredients: 10% poly(vinylformal), 5% BDS, 6% DBP and 3.6% triphenylphosphite. These films are exposed to radiation emitted from an unfiltered mercury arc and some of the irradiated films are heated for varying periods of time. The results of this experiment are set out in Table IV.

TABLE IV

| Sample | Irradiation Time (Minutes) | Heating Time (Minutes) | Heating Temp. (° F) | Results |
|---|---|---|---|---|
| 1 | 5 | — | — | Image Observed |
| 2 | 5 | 5 | 170 | Image Intensified |
| 3 | 3 | — | — | Image Observed |
| 4 | 3 | 3 | 180 | Image Intensified |
| 5 | 1 | — | — | Latent Image Formed |
| 6 | 1 | 1 | 180 | Image Developed |
| 7 | 0.5 | 0.5 | 180 | No Imaging |

EXAMPLE XI

Microimaging films are cast from a methylenechloride solution containing the following ingredients: 10% poly(vinylformal), 5% BDS, 6% DBP and 3.4% triparatolylphosphite. These films are exposed to radiation emitted from an unfiltered mercury arc and some of the irradiated films are heated to 180° F for varying periods of time. The results of this experiment are set out in Table V.

TABLE V

| Sample | Irradiation Time (Minutes) | Heating Time (Minutes) | Results |
|---|---|---|---|
| 1 | 5 | — | Faint Image |
| 2 | 5 | 5 | Image and Background Develop |
| 3 | 3 | — | Image Observed |
| 4 | 3 | 3 | Image and Background Develop |
| 5 | 1 | — | Latent Image Forms |
| 6 | 1 | 1 | Latent Image Develops Faintly |

What is claimed is:

1. A microimaging composition comprising a film of an organic polymer as matrix material having uniformly dispersed therein:

i. a photochemically reactive organo diselenide characterized by the formula:

$$R_1—Se—Se—R_2$$

wherein $R_1$ and $R_2$ are aralkyl or alkyl hydrocarbon moieties;

ii. a tertiary phosphine or phosphite characterized by the formula:

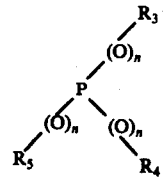

wherein each $n$ is 0 in the case of a phosphine and 1 in the case of a phosphite and $R_3$, $R_4$ and $R_5$ are independently substituted or unsubstituted aryl hydrocarbon moieties; and iii. an organic peroxide characterized by the formula:

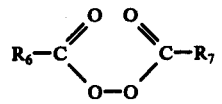

wherein $R_6$ and $R_7$ are aryl or substituted aryl.

2. The composition of claim 1 wherein $R_1$ and $R_2$ are independently selected from the group of benzyl, alkyl substituted benzyl, amino substituted benzyl, amido substituted benzyl, arylalkyl substituted benzyl, aryl substituted benzyl, alkoxy alkyl substituted benzyl, amino alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxy substituted benzyl, cyano substituted benzyl and alkyl alkoxy, amino substituted alkyl, amido substituted alkyl, aryl alkyl, alkoxy alkyl, aryloxy alkyl, hydroxy substituted alkyl, carbonyl substituted alkyl, thio substituted alkyl, seleno substituted alkyl, carboxamido substituted alkyl, halogen substituted alkyl and nitro substituted alkyl; cyclo alkyl and substituted cyclo alkyl.

3. The composition of claim 1 wherein $n$ is zero.

4. The composition of claim 3 wherein the tertiary phosphine is triphenylphosphine; tri-para-methylphenylphosphine; ortho-bromophenyldiphenylphosphine; tri-orthotolylphosphine; tri-metatolylphosphine, tris-parafluorophenylphosphine or para-tolyldiphenylphosphine.

5. The composition of claim 1 wherein $n$ is 1.

6. The composition of claim 5 wherein the tertiary phosphite is triphenylphosphite or tri-para-tolylphosphite.

7. The composition of claim 1 wherein the organic peroxide is dibenzoylperoxide or a para substituted dibenzoylperoxide.

8. The composition of claim 7 wherein the para substituted dibenzoylperoxide is mono- or di-substituted with an alkyl group of from 1 to 4 carbon atoms.

9. The composition of claim 1 wherein the matrix polymer is poly(vinylchloride), poly(vinylformal), poly(vinylbutryal), poly(vinylalcohol), poly(methylmethacrylate), poly(vinylpyrrolidone) or poly(vinylidenechloride).

10. The composition of claim 1 wherein the matrix polymer is poly(methylmethacrylate), the organo diselenide is benzyl diselenide, the tertiary phosphine is triphenylphosphine and the organic peroxide is dibenzoylperoxide.

* * * * *